US007503080B2

(12) United States Patent
Link

(10) Patent No.: US 7,503,080 B2
(45) Date of Patent: Mar. 17, 2009

(54) CHEST WALL PROTECTOR

(75) Inventor: Mark S. Link, Newton, MA (US)

(73) Assignee: Tufts Medical Center, Inc., Boston, MA (US)

( * ) Notice: Subject to any disclaimer, the term of this patent is extended or adjusted under 35 U.S.C. 154(b) by 435 days.

(21) Appl. No.: 11/127,548

(22) Filed: May 12, 2005

(65) Prior Publication Data

US 2005/0251901 A1 Nov. 17, 2005

Related U.S. Application Data

(60) Provisional application No. 60/570,335, filed on May 12, 2004, provisional application No. 60/591,494, filed on Jul. 27, 2004.

(51) Int. Cl.
*A41D 13/00* (2006.01)

(52) U.S. Cl. ..... 2/463

(58) Field of Classification Search ..... 2/463, 2/2.5, 115, 267, 92, 94, 455, 464, 465
See application file for complete search history.

(56) References Cited

U.S. PATENT DOCUMENTS 4,441,211 A * 4/1984 Donzis ..... 2/459
4,535,478 A * 8/1985 Zufle ..... 2/2.5
5,495,620 A * 3/1996 Schoenweiss et al. ..... 2/2.5
5,621,914 A * 4/1997 Ramone et al. ..... 2/463
5,950,249 A * 9/1999 Clement ..... 2/463
6,035,452 A 3/2000 Braxton ..... 2/455
6,295,654 B1 * 10/2001 Farrell ..... 2/456
6,446,273 B1 9/2002 Gillen et al. ..... 2/455

FOREIGN PATENT DOCUMENTS

WO WO 2006/092551 A1 9/2006

OTHER PUBLICATIONS

Link et al. *New Engl. J. Med.*, 338(25):1805-1811 (1998).
Link et al. *Circulation*, 100:413-418 (1999).
Link *Heart*, 81:109-110 (1999).
Maron et al. *J. Cardiovasc. Electrophysiol.*, 10:114-120 (1999).
Link et al. *Cardiology in Review*, 7(5):265-269 (1999).

* cited by examiner

*Primary Examiner*—Tejash Patel
(74) *Attorney, Agent, or Firm*—Mintz, Levin, Cohn, Ferris, Glovsky and Popeo, P.C.

(57) ABSTRACT

A chest wall protector comprises a shell made of a relatively hard, rigid material, a cushion attached to the shell such that the cushion is disposed between the shell and a thoracic wall of a person outside of a region over a heart of the person when the protector is worn by the person, and a garment configured to be worn by the person and to retain the shell and cushion in positions to protect a portion of the thoracic wall of the person when the garment is worn by the person.

16 Claims, 3 Drawing Sheets

CHEST WALL PROTECTOR

RELATED APPLICATIONS

This application claims priority to U.S. Provisional Application Ser. No. 60/570,335, filed May 12, 2004 and entitled, "Chest Wall Protector," and to U.S. Provisional Application Ser. No. 60/591,494, filed Jul. 27, 2004 and entitled, "Commotio Cordis Testing" each of which is herein incorporated by reference.

BACKGROUND OF THE INVENTION

Sudden (and usually immediate) death due to impact to the chest (a phenomenon known as commotio cordis) in the absence of underlying cardiac disease has occurred in at least 170 documented cases. The object that initiates the commotio cordis is generally traveling at a speed greater than 25 miles per hour when it strikes the person, which initiates instantaneous ventricular fibrillation. The deaths typically result from impact during sports, e.g., by being hit by a baseball, a puck, a softball, a lacrosse ball, or a hand, foot, or elbow (e.g., in martial arts). Efforts have been undertaken to mandate the use of chest protection for at-risk sports participants such as lacrosse players.

SUMMARY OF THE INVENTION

In general, in an aspect, the invention provides a chest wall protector. The chest wall protector includes a shell made of a relatively hard, rigid material, a cushion attached to the shell such that the cushion is disposed between the shell and a thoracic wall of a person outside of a region over a heart of the person when the protector is worn by the person, and a garment configured to be worn by the person and to retain the shell and cushion in positions to protect a portion of the thoracic wall of the person when the garment is worn by the person.

Implementations of the invention may include one or more of the following features. The cushion may comprise an impact-absorbing material. The chest wall protector can include a soft material disposed between the shell and the thoracic wall of the person in the region over the heart of the person when the protector is worn by the person. The cushion may substantially laterally enclose the soft material. The cushion may displace the shell from the thoracic wall of the person. The shell and the cushion can be configured to reduce the effective speed of an object striking the chest protector. The effective speed of the object striking the chest protector can be reduced to below about 25 miles per hour. The protector can be configured to inhibit an object striking the protector from significantly increasing a peak pressure induced in a left ventricle of the person's heart. The protector can be configured to inhibit a peak left ventricular pressure from exceeding about 250 mm Hg.

Further implementations of the invention may include one or more of the following features. The cushion can be configured to disperse an energy of an object striking the chest wall protector to an area outside the region of the heart of the person. The garment can be a lightweight undergarment comprising at least one of mesh, cotton or lycra. The shell can be positioned off-center of the person's body when the garment is worn by the person. The chest wall protector can include a second shell portion positioned substantially adjacent to the rigid shell, the second shell portion and the rigid shell separated by a gap in the garment. The shell may comprise one of a flat shell or a domed shell. The shell can be substantially lung-shaped.

In general, in another aspect, the invention provides a chest wall protector that includes a substantially hard shell, and a flexible layer, attached to the hard shell, the flexible layer including a first, soft portion disposed over a region of the heart of a person wearing the chest wall protector, and a second, impact-absorbing portion, the flexible layer positioned to be in contact with the person. The protector is configured to reduce an effective speed of an object striking the protector, when a person is wearing the protector, at an actual speed greater than 25 mph, to below about 25 mph.

Implementations of the invention may include one or more of the following features. The chest wall protector can be configured to reduce a peak left ventricular pressure of the heart of the person to less than 250 mm Hg. A thickness of the flexible layer can be between about 0.25 inches and about 1 inch. The flexible layer can be configured to disperse an energy of an object striking the chest wall protector primarily to an area outside the region of the heart of the person. The second impact-absorbing portion can substantially laterally enclose the first soft portion. The shell and the flexible layer can be embedded in a garment configured to be worn by the person and to retain the shell and cushion in positions to protect a portion of the thoracic wall of the person when the garment is worn by the person.

Various aspects of the invention may provide one or more of the following capabilities. A chest protector can disburse energy from an impact. Impact energy can be directed away from a person's heart. The risk of sudden death due to chest wall impact may be reduced. Energy over time delivered to a heart from impact of an article upon a person can be dampened or decreased (i.e., the rate of energy delivery can be slowed).

These and other capabilities of the invention, along with the invention itself, will be more fully understood after a review of the following figures, detailed description, and claims.

DETAILED DESCRIPTION OF PREFERRED EMBODIMENTS

Embodiments of the invention provide techniques for guarding against commotio cordis. A chest protector can comprise a relatively rigid material shaped to cover a person's heart and be displaced from the person's chest wall over the heart with the protector worn by the person. The rigid material is shaped to disperse energy from an article that hits the protector. A relatively flexible, impact-absorbing material is connected to the rigid material and is disposed between the rigid material and the person's chest when the protector is worn by the person. Embodiments of the invention can be used, e.g., during play in sports such as lacrosse, baseball, field hockey, ice hockey and karate. Other embodiments and applications are within the scope of the invention.

Some specific conditions have been discovered to induce commotio cordis. For example, it has been discovered that an object such as a baseball (i.e., a hardball) or lacrosse ball will likely induce commotio cordis if the ball hits a person's chest wall over the person's heart with a speed at impact over about 25 mph. Commotio cordis is likely induced if the peak left ventricular (LV) pressure exceeds about 250 mm Hg and the impact occurs at about 30 ms to about 15 ms before the peak of the T-wave. Thus, reducing the effective speed of an object hitting a person's chest such that the maximum peak induced LV pressure is less than about 250 mm Hg has been discovered to be desirable.

Figure 1:
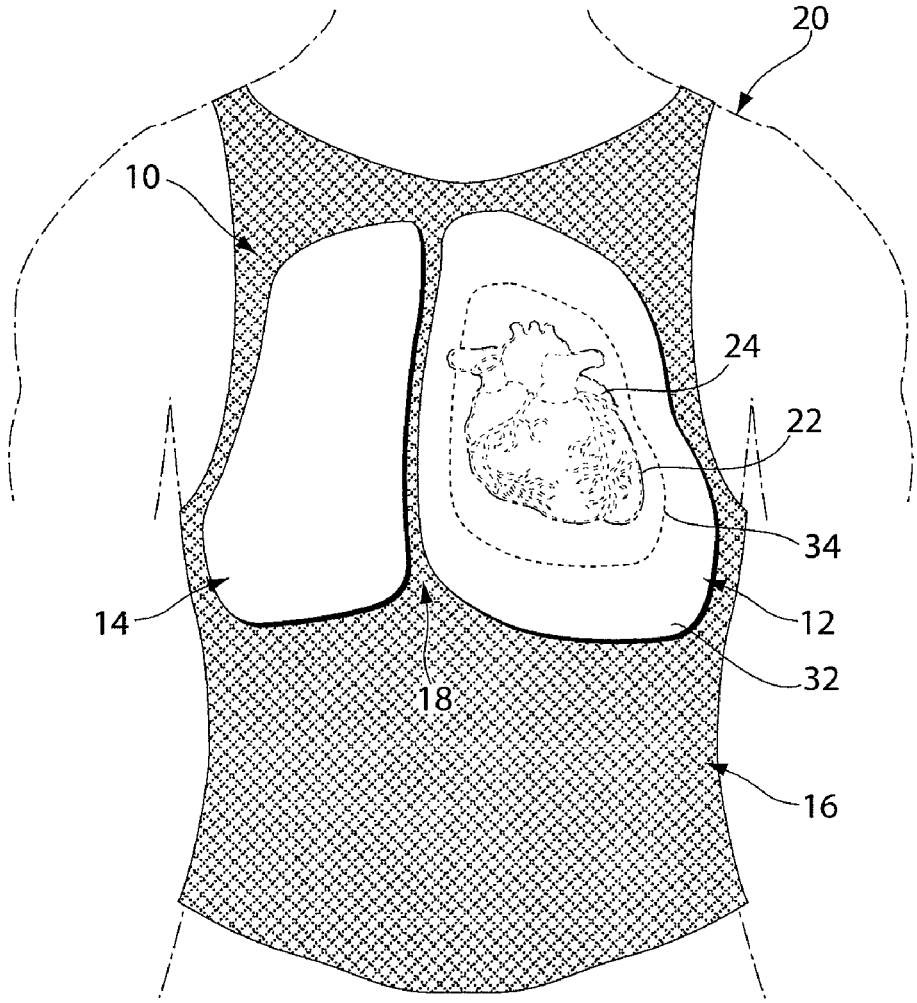
FIG. 1 is a front view of a torso of a person and a chest wall protector.

Referring to FIG. 1, a chest wall protector 10 includes a left (from the person's perspective) protector panel 12 and a right protector panel 14 embedded in a garment 16. The garment 16 is preferably a lightweight, substantially form-fitting undergarment that is pulled over the head of a person 20, such as a tank top (as shown), a tee shirt, a long sleeve shirt, etc. The garment can be made of lycra, cotton, thinsulate, mesh or other material, preferably of light weight, and preferably possessing the ability to form fit to the body of the person 20. The left panel 12 and the right panel 14 are embedded in the garment 16 separated by a gap 18. The gap 18 is positioned to the right of midline (i.e., off center of the person 20), e.g., such that the panel 12 covers the person's breastbone. The gap 18 can be between about 2 and 3 centimeters to the right of midline. The gap 18 between the left panel 12 and the right panel 14 provides a hinge point between the right side and the left side of the protector 10. The gap 18 provides, for example, flexibility for free movement of the wearer of the chest protector 10. The gap 18 can be, for example, a space of approximately ¼ inch, although a smaller or larger gap is possible.

The panels 12, 14 are able to move relative to each other, e.g., being connected by a portion of material of the garment 16, a hinge mechanism (not shown), another coupling mechanism, etc. Each of the left panel 12 and the right panel 14 preferably extends from the area at or near the clavicle (collar bone) of the person 20, to the area at or near the bottom of the rib cage of the person 20. The protector 10 provides protection for the person's chest especially the heart, while preferably allowing substantially free movement of the person's arms, e.g., to help limit the affect on the person's ability to move, e.g., for sports.

The left panel 12 of the chest wall protector 10 includes soft material 34 positioned and configured to cover at least a portion of a silhouette 22 of a heart 24 of the person 20. Preferably, the left panel 12 of the protector 10 is configured, e.g., shaped, to cover the heart 24 during various movements of the person. The left panel 12 is positioned in the garment 16 so that a person 20 wears the protector 10 with the left panel 12 over/covering the silhouette 22 of the heart 24. The left panel 12 is shaped and sized to cover the silhouette 22 of the heart 24 and the left chest wall area, e.g., being lung-shaped as shown in FIG. 1, although other shapes may be used. The protector 10 covers substantially the area from the collar bone to the bottom of the rib cage of the person 20. The left panel 12 extends to about the 45-degree midaxillary position, i.e., substantially immediately anterior to the person's arm when the arm is hanging at the person's side. The left panel 12 of the protector 10 is contoured from left to right. For example, the left panel 12 is contoured similarly to the lateral contour of the person's ribs. The left panel 12 of the protector 10 is disposed off-center of the person's chest toward the person's left, as that is where the heart 24 resides. More preferably, the left panel 12 of the protector 10 will cover the heart 24 during most, if not all, movements of a person during a sporting activity, or at least those movements that are reasonably predictable and/or normal/common for the sport.

The right panel 14 is configured and positioned in the garment 16 to cover the right side of the chest wall of the person 20. The right panel 14 is contoured from left to right. The right panel 14 can be contoured similarly to the contour of the person's ribs from slightly to the person's right of midline to about the midaxillary position. The right panel 14 further provides protection to the chest area of the person 20, for example by protecting the right chest area from bruising caused by an object striking the chest.

Figure 2A:
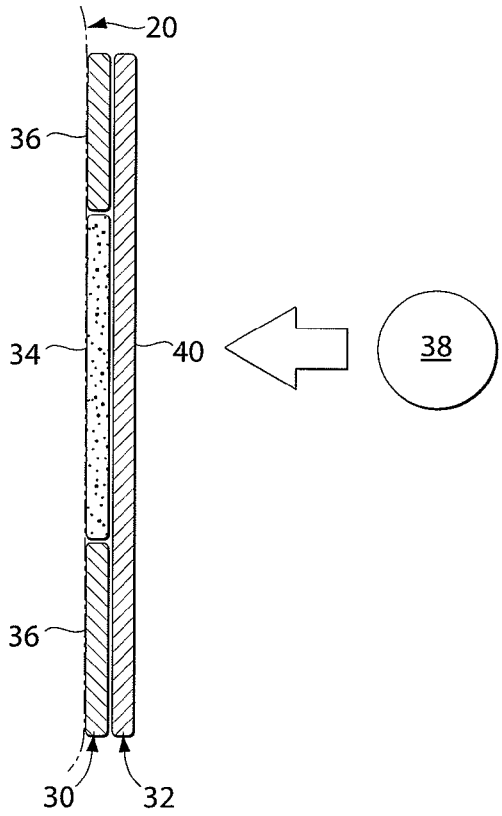
FIG. 2A is a cross-sectional view of the chest wall protector shown in FIG. 1 cut along a sagittal plane.

Referring also to FIG. 2A, the left panel 12 of the chest protector 10 includes an inner layer 30 and an outer shell 32. The inner layer 30 is positioned proximal to the person's body when the chest protector 10 is worn by the person 20, i.e., the inner layer 30 is between the person 20 and the outer shell 32. The inner layer 30 includes a relatively soft material 34 and an impact-absorbing material 36. The shell 32 and the materials 34, 36 are configured such that the panel 12 can inhibit incoming objects from inducing commotio cordis.

The outer shell 32 is configured to deflect energy of an article 38 (e.g., a baseball, puck, etc.) incident upon a front 40 of the protector 10 away from the silhouette 22 of the heart 24. The energy from the impacting article 38 will be dispersed and preferably directed to areas not directly over the heart 24, i.e., outside the silhouette 22 of the heart 24. The shell 32 is preferably made of a hard, rigid, substantially inflexible material. For example, the shell 32 can be made of polyethylene, polypropylene, a stiff version of Brock™ Foam or other plastics or other materials that are substantially rigid. The shell 32 of the left panel 12 covers the area over the heart 24 when worn by the person 20. The shell 32 is displaced from the chest wall of the person 20 in the area of the cardiac silhouette 22 by the inner layer 30 when the protector 10 is worn by the person 20.

The soft material 34 is positioned and configured to cover at least a portion of the heart 24 and soften impacts to the chest when the protector 10 is being worn. The soft material 34 may be positioned and configured to cover the entire heart silhouette 22 or less than all of the heart silhouette 22. For example, the soft material 34 can cover the area of the left ventricle of the heart 24. The soft material 34 is disposed under the shell 32 in the region that is disposed over the heart 24 while the protector 10 is used/worn by the person 20. The soft material 34 can be polyethylene beads, foam or other materials. The soft material 34 can range in thicknesses, e.g., from a thickness of about ⅛ inch to about ¾ inch, although other thicknesses including more than ¾ of an inch may be used. The soft material 34 is preferably also impact-absorbing.

Figure 2B:
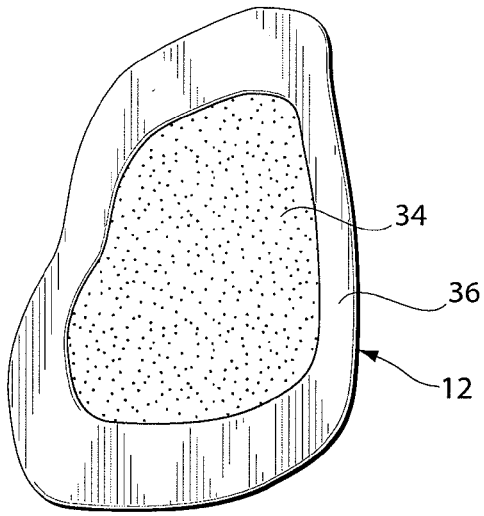
FIG. 2B is a front view of a left panel of the chest wall protector shown in FIG. 1.

Referring also to FIG. 2B, the left panel 12 of the protector 10 also includes a cushion 36 connected to the shell 32. The cushion 36 is configured to absorb impact energy and to protect the chest area of the person 20 when the chest protector 10 is being worn. The cushion 36 is preferably relatively hard, yet configured to absorb energy. For example, the cushion 36 may be made of Brock™ Foam made by Brock USA of Boulder, Colo., although other materials may be used. The cushion 36 preferably has a thickness between about ½ inch and 1 inch, although other thicknesses, e.g., greater than 1 inch, may be used. The cushion 36 is preferably connected to the shell 32 such that the cushion 36 is disposed between the shell 32 and the thoracic wall of the person 20 when the protector 10 is in use. The cushion 36 is disposed about a perimeter of the shell 32. The cushion 36 laterally encloses the soft material 34 of the left panel 12. The cushion 36 is preferably configured to help dampen or decrease the amount of energy transferred from the article 38 to the person 20 if the article hits the protector 10 versus if the article 38 hits the person 20 directly and to help direct the energy away from (outside of) the silhouette 22.

In FIG. 2B, the inside of the left panel 12 includes the soft material 34 and the impact-absorbing material 36 bounding the soft material 34. During use, the soft material 34 and the cushion 36 are in contact with the person using/wearing the chest protector 10. In alternate embodiments, the cushion 36 covers portions, such as the top, the bottom or the edges of the left panel 12, but may not completely border the soft material 34. The soft material 34 can be disposed on the left panel 12 in any of a number of shapes and/or sizes to cover some or all of the silhouette 22 of the heart 24 of the person 20.

The shell 32, the soft material 34 and the cushion 36 can work in concert to help lessen the effect of the incident article 38. The shell 32 spreads the force of the impact of an object over a greater area, and the soft material 34 and cushion 36 increase the temporal transfer of energy (i.e., slow the transfer of energy) to the chest wall and myocardium. It has been shown that balls or other objects striking the chest at a speed of 25 miles per hour or less rarely initiate fatal arrhythmias. Further, where peak left ventricular pressure produced by a blow to the chest wall is less than 250 mm Hg, life threatening arrhythmias to the heart 24 are rarely produced. Thus, preferably, the chest protector 10 decreases the energy transfer from an object's impact to the chest such that the object's effective speed is less than about 25 mph. The effective speed is the speed of the object if unimpeded (i.e., without the protector 10) to the person's chest over the heart 24 that would induce substantially equal effect upon the heart 24 as the object at its actual speed striking the protector 10 induced. The chest protector 10 can preferably correspondingly decrease the peak left ventricular pressure generated by the impact to less that 250 mm Hg.

Preferably, the shell 32, the material 34, and/or the cushion 36 can reduce the effect of the impacting article 38 (at least of expected articles such as baseballs, lacrosse balls, pucks, etc. incident at expected speeds, e.g., up to about 120 mph) upon the protector 10 to the effect of impact of the article (or possibly of a baseball or lacrosse ball) directly hitting the thoracic wall at about 25 mph or less. For example, the energy/momentum of a ball or other object hitting the chest protector 10 at a speed between 25 miles per hour and 120 miles per hour that is transferred to the heart 24 is reduced to the equivalent of the object striking the person's chest below 25 miles per hour.

Figure 3:
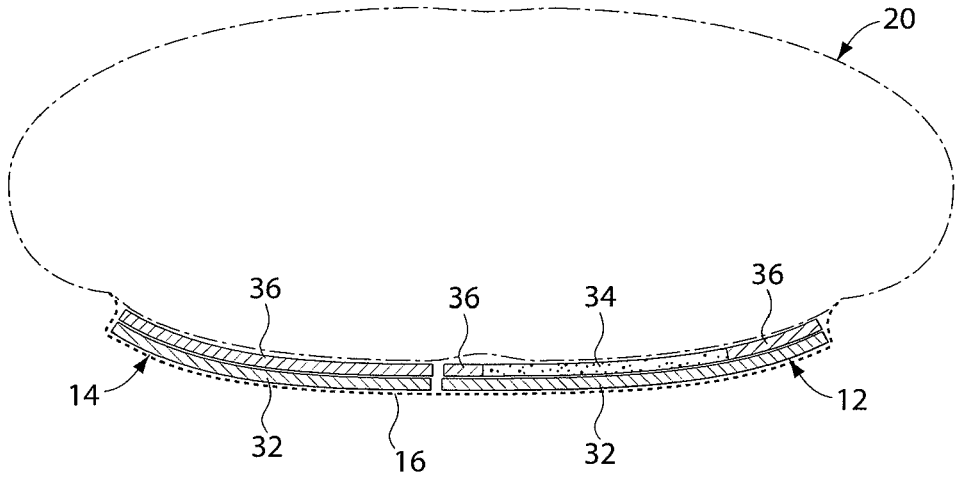
FIG. 3 is a simplified cross-sectional view of the torso of the person and the chest wall protector shown in FIG. 1 cut along a plane transverse to a sagittal plane.

Referring to FIG. 3, the chest protector 10 is disposed on the person 20. The garment 16 holds the protector 10 in place such that the protector 10 substantially fits/conforms to the person's chest. The garment 16 of the protector 10 is configured to retain the protector's position over the person's heart silhouette 22 (FIG. 1) during activity, e.g., sports activity.

Various thicknesses can be used for each of the right panel 14 and the left panel 12, especially of the inner layer 30, of the chest protector 10. For example, particular thicknesses of the panels 12, 14 can be applicable for different sports, users of different ages and sizes, and other variables. The chest protector 10 can come in different sizes, such as small, medium and large, and the thickness of the right panel 14 and the left panel 12 preferably increases with increasing size. Larger sizes can be associated with older persons that may use a thicker chest protector 10 than a younger person, as balls or pucks used in more advanced athletics may be moving at faster speeds that those used in younger athletic programs. For example, ball speeds in little league baseball are slower than in high school baseball. Also, different thicknesses may be associated with different sports depending on the ball speeds of the sports. For example, ball speeds in lacrosse generally are higher than those in baseball. A lacrosse chest protector can include a relatively thicker inner layer 30 and a relatively thicker outer layer 32, while a baseball chest protector 10 includes a relatively thinner inner layer 30 and a relatively thinner outer layer 32. The ratio of area covered by the chest protector 10 to the thickness of the left panel 12 and right panel 14 can be constant, i.e., as the area covered increases, the left panel thickness used can be increased correspondingly.

Other embodiments are within the scope and spirit of the invention and the appended claims. For example, the chest protector 10 of FIG. 1 comprises a garment into which protective panels are embedded. Alternatively, a protector can include appropriate mounting apparatus such as straps, strings, etc. to attach the left protector panel 12 to the person 20 or otherwise have the person 20 wear the protector over/covering the silhouette 22 of the heart 24, or a portion thereof. The shell 32 was shown as relatively flat but contoured similar to the rib contour, with the relatively hard cushion 36 disposed in a configuration outside of the silhouette 12 of the heart 14 (e.g., in a continuous or non-continuous ring, circle, or other shape) such that impact energy is primarily transferred through the shell 32 and the cushion 36 to the person 20 outside of the heart silhouette 22. The shell, however, can be additionally contoured, e.g., dome-shaped or hemispherically-shaped, e.g., such that the area overlying the cardiac silhouette (or portions thereof) extends away from the chest wall of the person 20, and the margins of the shell with the material are in contact with the chest wall at an area distant from the cardiac silhouette. The cushion may not be impact absorbing. The cushion may be omitted and a hard shell shaped similar to shell 32 and cushion 36 in the figures can disperse, but not significantly absorb, the impact energy. In the chest protector as shown, the gap between the left panel and the right panel is off-center, or right of the midline of the person's body. In other embodiments, the gap can be substantially positioned along the midline of the person, e.g., with the left panel and the right panel substantially the same size and positioned on either side of the center of the person's chest. Further, the chest protector may include a left panel 12, but not a right panel 14, such that the protection is provided to the area over the heart, but not to the area over the right chest wall. The left panel 12 may extend over an area substantially smaller than the area between the collar bone and the bottom portion of the rib cage of the person 20. The left panel 12 may include the soft material 34 covering substantially all of the inside wall of the shell to protect the heart and chest area. Also, while the description above refers to "the invention," more than one invention may be described.

What is claimed is:

1. A chest wall protector comprising:

a shell made of a substantially hard, rigid material;

a cushion comprising an impact-absorbing material attached to the shell such that the cushion is disposed between the shell and a thoracic wall of a person outside of a region over a heart of the person when the protector is worn by the person;

a soft material disposed between the shell and the thoracic wall of the person inside of the region over the heart of the person when the protector is worn by the person, the soft material defining an outer perimeter; and a garment configured to be worn by the person and to retain the shell and cushion in positions to protect a portion of the thoracic wall of the person when the garment is worn by the person;

wherein the cushion is substantially co-planar with the soft material, and is disposed outside of the outer perimeter of the soft material; and wherein the cushion and the soft material are attached to the shell.

2. The chest wall protector of claim 1 wherein the cushion displaces the shell from the thoracic wall of the person.

3. The chest wall protector of claim 1 wherein the shell and the cushion are configured to reduce the effective speed of an object striking the chest protector.

4. The chest wall protector of claim 3 wherein the effective speed of the object striking the chest protector is reduced to below about 25 miles per hour.

5. The chest wall protector of claim 1 wherein the protector is configured to inhibit an object striking the protector from significantly increasing a peak pressure induced in a left ventricle of the person's heart.

6. The chest wall protector of claim 5 wherein the protector is configured to inhibit a peak left ventricular pressure from exceeding about 250 mm Hg.

7. The chest wall protector of claim 1 wherein the cushion is configured to disperse an energy of an object striking the chest wall protector to an area outside the region of the heart of the person.

8. The chest wall protector of claim 1 wherein the garment is a lightweight undergarment comprising at least one of mesh, cotton or spandex.

9. The chest wall protector of claim 1 wherein the shell is positioned off-center of the person's body when the garment is worn by the person.

10. The chest wall protector of claim 1 further comprising a second shell portion positioned substantially adjacent to the rigid shell, the second shell portion and the rigid shell separated by a gap in the garment.

11. The chest protector of claim 1 wherein the shell comprises one of a flat shell or a domed shell.

12. The chest protector of claim 1 wherein the shell is substantially lung-shaped.

13. A chest wall protector comprising:

a substantially hard shell; and a flexible layer, attached to the hard shell, the flexible layer including a first, soft portion disposed over a region of the heart of a person wearing the chest wall protector, and a second, impact-absorbing portion, disposed outside of the region of the heart of the person wearing the chest wall protector, which is substantially co-planar with the first soft portion, the flexible layer positioned to be in contact with the person, wherein the protector is configured to reduce an effective speed of an object striking the protector, when a person is wearing the protector, at an actual speed greater than 25 mph, to below about 25 mph;

wherein the flexible layer is configured to disperse an energy of an object striking the chest wall protector primarily to an area outside the region of the heart of the person;

wherein the soft portion defines an outer perimeter and the impact-absorbing portion is disposed outside of the outer perimeter of the soft portion, and wherein the soft portion and the impact-absorbing portion are attached to the hard shell.

14. The chest wall protector of claim 13 further configured to reduce a peak left ventricular pressure of the heart of the person to less than 250 mm Hg.

15. The chest wall protector of claim 13 wherein a thickness of the flexible layer is between about 0.25 inches and about 1 inch.

16. The chest wall protector of claim 13 wherein the shell and the flexible layer are embedded in a garment configured to be worn by the person and to retain the shell and cushion in positions to protect a portion of the thoracic wall of the person when the garment is worn by the person.

* * * * *

UNITED STATES PATENT AND TRADEMARK OFFICE

CERTIFICATE OF CORRECTION

PATENT NO. : 7,503,080 B2
APPLICATION NO. : 11/127548
DATED : March 17, 2009
INVENTOR(S) : Mark S. Link It is certified that error appears in the above-identified patent and that said Letters Patent is hereby corrected as shown below:

On the Title Page,

Item [*] Notice: Subject to any disclaimer, the term of this patent is extended or adjusted under 35 USC 154(b) by (435) days Delete the phrase "by 435 days" and insert -- by 515 days --

Signed and Sealed this

Thirteenth Day of July, 2010

David J. Kappos

David J. Kappos
*Director of the United States Patent and Trademark Office*